US005490298A

United States Patent [19]

Goldsmith et al.

[11] Patent Number: 5,490,298

[45] Date of Patent: Feb. 13, 1996

[54] MODULAR HIGH-LOW-ADJUSTABLE CONTOUR-ADJUSTABLE BED

[75] Inventors: Aaron Goldsmith, Long Beach, Calif.; Craig Adams, Medford, Oreg.

[73] Assignee: Rosalyn Goldsmith, Wheeling, Ill.

[21] Appl. No.: 193,796

[22] Filed: Feb. 8, 1994

[51] Int. Cl.[6] ..... A61G 7/00

[52] U.S. Cl. ..... 5/611; 5/620; 5/613

[58] Field of Search ..... 5/11, 611, 613, 5/620, 659, 660, 509.1

[56] References Cited

U.S. PATENT DOCUMENTS

| | | | |
|---|---|---|---|
| 2,280,444 | 4/1942 | Neunherz | 5/11 |
| 2,523,076 | 9/1950 | Sweetland | 5/611 |
| 2,830,303 | 9/1958 | Sandock | 5/509.1 X |
| 3,174,722 | 3/1965 | Alm | 5/611 X |
| 3,887,950 | 6/1975 | Wachsman | 5/11 |
| 4,381,571 | 5/1983 | Elliott | 5/620 X |
| 4,654,903 | 4/1987 | Chubb et al. | 5/509.1 X |

*Primary Examiner*—Michael F. Trettel
*Attorney, Agent, or Firm*—William C. Fuess

[57] ABSTRACT

A high-low base including a lower frame member supported upon a floor, an upper frame member, and an elevation assembly for variably elevating the upper frame member in height above the lower frame member, fits completely under, and within the pedestal base, of a conventional contour bed. A motorized drive mechanism variably controllably elevates the upper frame member in height above the lower frame member, and the entire contour bed including its pedestal base in height above the floor, in order to facilitate transfer of a bed user to and from a wheelchair, or the provision of care to the user supine within the bed. An upper surface of the contour bed is adjustable to contour a mattress that rests upon this upper surface mechanically and electrically independently of the adjustment of the height of the bed. Various combinations of height-and-contour-adjustable, height-adjustable, contour-adjustable, and non-adjustable bed units may be harmoniously aesthetically and functionally combined, particularly for use in the home.

11 Claims, 2 Drawing Sheets

MODULAR HIGH-LOW-ADJUSTABLE CONTOUR-ADJUSTABLE BED

BACKGROUND OF THE INVENTION

1. Field of the Invention

The present invention generally concerns adjustable beds. The present invention particularly concerns beds that are (i) modular in construction, (ii) adjustable in height above the floor, and (iii) adjustable in the contours of a mattress that is supported upon the bed.

2. Description of the Prior Art

The present invention will be seen to concern modular beds that are adjustable in (i) height above the floor as well as in (ii) the contours of a that is mattress supported upon the bed.

Hospital Beds

A true hospital bed is typically adjustable in both (i) height and (ii) contour. However, a hospital bed is typically an integral unit, i.e., non-modular, and is normally of considerable size and weight. The considerable size and weight of a hospital bed is fully satisfactory for hospital purposes, and, indeed, contributes to the durability and stability of the bed. A hospital bed is normally only but infrequently moved, and then solely within the confines of a hospital. The normal use of the bed requires bringing a patient, on a wheelchair or gurney if necessary, to the bed. When a hospital bed is moved then it is normally transported by rolling on strong casters over non-resilient hard floors, and by freight elevator between the floors of a multi-story building.

A hospital bed is also very distinctive in appearance, and considerably different from conventional household beds and bedroom furnishings. The frame of a hospital bed is typically made entirely of metal which is often polished or painted. The metal frame of the bed is typically only but minimally shielded from view, and then typically only by panels and side-boards of man-made material typically having a hard, smooth and durable surface. The aesthetic appearance of a hospital bed is secondary to its required functionality, including a required easy access to its frame in order that it may be cleaned and sanitized as necessary.

Because of all these characteristics a hospital bed is normally sufficiently visually distinctive so that it may be unambiguously and easily identified to so be a hospital bed even should it appear in incongruous circumstances such as, for example, in a home bedroom.

Contour Beds

Meanwhile, a type of bed having some, or all, of the capabilities of a hospital bed to adjust the contours of a mattress—but lacking the capability of a hospital bed to raise and lower the mattress in height above the floor—is called a contour bed. In the advanced industrial countries including the U.S.A. contour beds are, circa 1994, routinely sold for home use.

Contour beds use normal household sheets, blankets and other bedding. They are, in accordance with their intended environment of use, quite normally appearing relative to non-contour household beds. They may, for example, have platform bases that are surfaced in wood, vinyl padding, or other materials suitably incorporated in the decor of a home bedroom.

Contour beds may have double, or split, mattresses with each side of the bed being independently adjustable under separate control of the occupant of that side. Sometimes one contour bed, typically of twin size, is placed side-by-side with an identically externally-appearing bed that, while having a same or similar mattress, rests upon a base that is without the capability of contour adjustment. In this manner a sole occupant, or a couple only one of whom desires contour adjustment, may save the cost of having the entire surface of the bed to be adjustable while preserving the form factor of a double twin, or king size, bed.

Home Requirements For Certain Features of a Hospital Bed In Combination With Certain Features of a Contour Bed It is desirable to combine the capability of a hospital bed to be adjustable in height above the floor with the suitable appearance of a contour bed for location in the bedroom of a private home. The capability of the contour bed to adjust the contours of a mattress that it supports must be preserved.

The fundamental reasons why it is useful to have a bed that is adjustable in height in a home setting are the same as it is in a hospital setting: to facilitate (i) transfers into the bed, (ii) transfers out of the bed, and/or (iii) the rendering of care by a person standing or sitting alongside the bed to a person, normally supine, located on the bed.

An individual may most easily transfer from a wheel chair to a bed, and vice versa—whether with assistance or unassisted—when the bed surface is twenty inches (20") in height, or less, above the floor upon which both the bed and the wheelchair rest. Transfers into the bed from a wheelchair are normally conducted level, or sometimes with the bed slightly lower in order that gravity may assist the transfer. Likewise, an individual normally transfers most easily from a bed to a wheel chair—whether with assistance or unassisted—when the bed surface is at approximately the same height as the wheelchair seat above the floor upon which both the bed and the wheelchair rest. Transfers from the bed into a wheelchair are normally conducted with the bed slightly higher in order that gravity may assist the transfer. The rendering of care to a person located on the bed is normally conducted when the bed surface is elevated considerably higher, typically thirty-two inches (32") high or higher, than is the same surface during occupant transfers. An individual within the bed is normally accorded discretionary control of the bed's height for purposes of better and more satisfactory interaction with the environment from the viewing of television and window scenes to the conduct of reading or conversation.

Some existing contour beds will, if not elevated on pedestals and when their mattress contours are set level, have a total height of 20" or less, and thus be roughly suitable for transfers to and from wheelchairs. Unfortunately, while a hospital bed will raise its occupant to the height convenient to any of (i) a caretaker, (ii) bedside furniture, (iii) bedside conversation, and/or (iv) the viewing of television after being entered by the occupant at a low height, a contour bed set low upon the floor has no such capability.

Moreover, there are special reasons, not present in a hospital, why within a home setting (i) a contour bed should be adjustable in height, or, alternatively and conversely, (ii) a height-adjustable bed should also be adjustable in contour. These reasons have to do with (i) interaction between a couple sharing a bed, and (ii) aesthetics of the bed during its occupancy by two, one or zero persons.

When one, physically-impaired, member of a couple sharing a bed has a requirement for access to the bed at some non-standard height (which height may be abnormally low or high) above the floor, there are good reasons why this portion of the bed should be adjustable in both height and contour. Adjustment in height is clearly desirable not only so that a portion of the bed that is so adjustable may be conveniently entered (or exited), but also so that this portion may be brought level with the remaining, height-unadjustable, portion of the bed for reasons of improved affinity, including conjugal relations, between occupants of the bed. It is extremely awkward and undesirable that one bed portion should be permanently superior or inferior in elevation to the other bed portion.

It is somewhat more subtle, but also true, that the portion of a home bed that is adjustable in height should also be adjustable in contour. It is desirable that a height-adjustable bed portion should also be contour-adjustable for the same reasons that couples often order dual-adjustable contour beds—both desire to individually and collectively enjoy the comforts of an adjustable mattress.

A dual-occupant, double size or larger, home bed is normally unoccupied by at least one occupant, and typically by both occupants, for substantial portions of the day. The unoccupied entirety, or part, of the bed may be made up, and covered by a bedspread, during this period for optimal aesthetic appearance. It is typically desirable, if only from the point of view of a sole occupant, that the unoccupied side portion of a double bed should not look incongruous all day long, such as by towering above or hovering below the occupied side portion. It is likewise desirable that, when the bed is vacated, both side portions should be made to be as visually identically appearing as is possible. These requirements are obviously satisfied when the portion of the bed that is adjustable in height and in contour is so adjustable to assume the height, and the contour, of the remaining, height-unadjustable, portion.

One, brute-force, solution to realizing the full (i) height and (ii) contour adjustment capabilities of a hospital bed in a home environment would be to adopt a hospital bed, as best as was possible, to the aesthetic, space and weight requirements of a home. Perhaps a hospital bed having no capability of adjustment in height, but preserving its capability to adjust the contour of the mattress, could be produced at reduced cost as a type of contour bed. Generally, however, a hospital bed is a large, integrated and very expensive structure that is neither well, nor easily, adapted to the home.

The present invention will be seen to take an alternative approach, and to attempt to enlarge the capabilities of existing contour bed—which contour beds are well-accepted in home use and which capabilities are well-proven—to encompass the height adjustability of a hospital bed while fully preserving the (i) aesthetics, (ii) substantial economies, and (iii) proven performance of the contour bed.

SUMMARY OF THE INVENTION

The present invention contemplates a modular high-low-adjustable contour-adjustable bed including (i) a high-low base portion that is adjustable in height above a floor, and, resting upon the high-low base portion, (ii) a contour bed portion suitable to adjust the contours of a mattress that it supports.

The present invention further contemplates a high-low base useable with, retrofittable to, and fitted under an existing contour bed. The high-low base is adjustable in height so as to vary the elevation of the contour bed above the floor.

1. An Embodiment of the Present Invention as a High-Low Adjustable Contour-Adjustable Bed The present invention is embodied in a modular high-low-adjustable contour-adjustable bed.

A high-low base portion of the high-low-adjustable contour-adjustable bed includes a lower frame member supported upon a floor, an upper frame member, and an elevation assembly for variably elevating the upper frame member in height above the lower frame member and above the floor upon which the lower frame member is supported.

The elevation assembly typically includes a motorized drive mechanism connecting between the lower frame member and the upper frame member and located in the volume between them. The motorized drive mechanism serves to variably controllably elevate the upper frame member in height above the lower frame member. An idler arm maintains the lower frame member and the upper frame member in positional alignment. The upper frame member commonly has and defines several, normally two (2), tracks while the motorized drive mechanism includes several, normally four (4), arms. The arms are each rotationally affixed to the lower frame member at one end, with the other end engaging and sliding within a corresponding one of the tracks of the upper frame member. A motor serves to drive the arms to various angles relative to each of the lower frame member and the upper frame member. The lower frame member and the upper frame member are thereby forced to a variable degree of separation one from the other.

In greater detail, two pairs of two arms each are preferably opposed upon opposite sides of both of a rectangularly-shaped lower, and an upper, frame member. The motorized drive mechanism includes a shaft connecting one pair of opposed arms at the points of the arms' rotatable affixation to the lower frame member, a lever arm connected at one of its two ends to the shaft, a screw follower affixed to the other end of the lever arm, a screw threading the screw follower, and an electric motor for rotating the screw. Rotation of the screw causes the screw follower and the one end of the lever arm affixed thereto to forcibly rotate the shaft, turning the pair of arms connected to the shaft and changing the angle thereof relative to each of the lower frame member and the upper frame member. As this angle changes the lower frame member and the upper frame member are forced to a variable degree of separation one from the other.

A contour bed portion of high-low-adjustable contour-adjustable bed stably rests upon the upper frame member of the high-low base portion. The contour bed portion has and presents an adjustable upper surface that serves to support, and for variably adjust the contours of, a mattress that rests upon this upper surface.

The contour bed portion commonly, and preferably, includes a surround skirt having horizontal dimensions that fit circumferentially about the high-low base portion, and a vertical dimension that serves to essentially completely bridge a vertical gap between the mattress and the floor when the high-low base portion is in its full down position. By this construction the surround skirt of the contour bed portion—nonetheless to being part of the contour bed portion and thus being variable in height above the floor in accordance that the high-low base portion varies the height of this contour bed portion—serves to surround the high-low base portion, and to enclose it from external view, when the high-low base portion is in its full down position. The surround skirt, being a part of the contour bed portion, is raised into the air above the floor when the upper frame member of the high-low base is elevated in height, making it appear, as is in fact the actual case, that the entire contour bed portion is being lifted off the floor.

Notably, the contour bed portion need not, and preferably does not, mechanically affix the high-low base portion. Instead, it is sufficient only that the contour bed portion should rest stably on the high-low base portion. In this position any adjustment in height of the upper frame member of the high-low base portion serves to commensurately adjust the height of the contour bed portion, and of the mattress that is supported upon the contour bed portion.

The upper frame member of the high-low base portion is adjustable in height independently that the contour bed portion serves to variably adjust the contours of the mattress that rests upon its upper surface.

The high-low-adjustable contour-adjustable bed of the present invention may be beneficially used in combination with an expansion bed that is located alongside. A preferred expansion bed includes a frame for supporting a mattress at a same height as is the mattress supported upon the high-low-adjustable contour-adjustable bed when the high-low base portion of the bed is in its full down position, and a surround skirt to the frame that substantially externally visually matches the surround skirt to the high-low-adjustable contour-adjustable bed. By this construction the high-low-adjustable contour-adjustable bed and the expansion bed are visually identically appearing when the high-low base portion of the high-low-adjustable contour-adjustable bed is in its full down position then. This visual identity is the case regardless that the expansion bed is not necessarily adjustable in either of (i) height or (ii) contour. Normally, however, the expansion bed is adjustable in contour (only)

.

2. An Embodiment of the Present Invention as a High-Low Base For Use With a Contour Bed The present invention is also embodied in a high-low base for use with a pre-existing conventional contour bed.

The base of a conventional contour bed is in the shape of a rectangular parallelipiped body. The parallelipiped body is defined by a box frame substantially in the shape of the four side walls of a rectangular box having an open bottom and an open top, and, as a top, a substantially planar bendable mattress support member for supporting a mattress upon its upper surface. The bottom of the parallelepiped body, and box frame, is open. A motor is located within the box frame, and is affixed between the box frame and the bendable mattress support member for variably bending this member in order that a variable contour may be imparted to the mattress that rests upon its upper surface. The motor normally occupies less than the totality of the parallelepiped volume enclosed by the box frame—making that a portion of the volume enclosed by the box frame is void.

A high-low base in accordance with the present invention for use with the conventional contour bed having this form of a box frame makes use of this void. The high-low base of the present invention includes a lower frame member supported upon a floor, an upper frame member, and an elevation assembly for variably elevating the upper frame member in height above the lower frame member and above the floor upon which the lower frame member is supported. The upper frame member is of suitably complimentary size and shape so as to engage the box frame of the contour bed—but at points inside of this box frame at a level that is above the frame's lowest points. This engagement permits the entire contour bed, including its entire frame, to be variably elevated in height above the floor as the upper frame member of the high-low base is elevated above the upper frame member of the high-low base.

Importantly, and nonetheless that the upper frame member of the high-low base engages the frame of the existing contour bed, substantially the entirety of the high-low base—its (i) lower frame member, (ii) upper frame member, and (iii) elevation assembly—fits completely within the void of the volume enclosed by the contour bed box frame when high-low base is in its full down position. To restate, the high-low adjustable base of the present invention fits almost completely inside the box frame of a preexisting, conventional, contour bed. The sole exception is intentional, consisting of head and foot support rails that are located on the exterior of the lower frame member of the high-low base. These two rails serve to engage the bottom side edges of a corresponding two sides of the box frame to the contour bed. These two rails serve to make that the high-low adjustable base—hidden to the ninety-ninth percent (99%) as it is within the box frame of the existing contour bed—is always between the contour bed and the floor by at least the slight thickness, approximately one-eighth inch (⅛"), of the head and foot support rails. These rails permanently underlying the contour bed—even when the high-low base is not elevated so as to raise the contour bed—has a simple purpose. Castors on the bottom of (only) the high-low adjustable base will always suffice to support for rolling both the high-low adjustable base and the contour bed that rest upon the high-low adjustable base. In accordance with the present invention, the substantial appearance and the complete functionality of an existing contour bed is preserved while a wholly new capability of adjusting the contour bed in height above the floor is added by retrofitting a high-low adjustable base in accordance with the present invention under the contour base. In this retrofit no mechanical nor any electrical connections are required, and no tools need be used.

3. An Embodiment of the Present Invention as an Apparatus and Method for Adjusting the Height of a Contour Bed Over a Useful Range A high-low base in accordance with the present invention for use with, under, and supporting a pre-existing contour bed is preferably greatly vertically extendible in height. The high-low adjustable base is so extended in height over a range from (i) a retracted first position supporting the contour bed at a low height suitable for a level transfer of a patient from a wheelchair to the bed, to (ii) an intermediary second position supporting the contour bed at an intermediary height suitable for a gravity-assisted transfer of a patient from the bed to a wheelchair, to (iii) an extended third position supporting the contour bed at a high height suitable for care-giving to a patient lying supine upon the bed.

The preferred high-low base that is adjustable over such a range includes a lower frame member, supported upon a floor, that is of complimentary size and rectangular shape so as to fit almost completely within a rectangular pedestal base of a pre-existing contour bed. An upper frame member—also of complimentary size and rectangular shape so as to fit completely within the rectangular pedestal base of the pre-existing contour bed—comes into contact with frame elements of the contour bed that are within its pedestal base. This contact permits forcible level lifting of these frame elements, the pedestal base, and the entire contour bed of which the base elements and pedestal base are a part. Finally, an elevation assembly connects, and is located in the volume, between the lower frame member and the upper frame member. The elevation assembly serves to variably elevate the upper frame member in height above the lower frame member and above the floor upon which the lower frame member is supported.

By this construction and operation, the lower frame member, the upper frame member and the elevation assembly of the high-low base are collectively so low and squat in a retracted first position that they all fit compactly within the rectangular pedestal base of the pre-existing contour bed. At this position the contour bed is at the low height suitable for the level transfer of the patient from the wheelchair to the bed. At a second position of the elevation assembly the upper frame member is vertically extended so as to lift the contour bed to the intermediary height suitable for the gravity-assisted transfer of the patient from the bed to the wheelchair. Finally, the third position of the elevation assembly vertically extends the upper frame member so as to lift the contour bed to the high height suitable for care-giving to the patient who typically lies supine upon the contour bed adjusted flat.

In summary, the high-low base of the present invention suffices to lift a pre-existing contour bed over a useful range of heights while retracting so low, and so compactly, so as to fit substantially completely within the dimensions of a pedestal base to the contour bed.

These and other aspects and attributes of the present invention will become increasingly clear upon reference to the following drawings and accompanying specification.

DESCRIPTION OF THE PREFERRED EMBODIMENT

Figure 1:
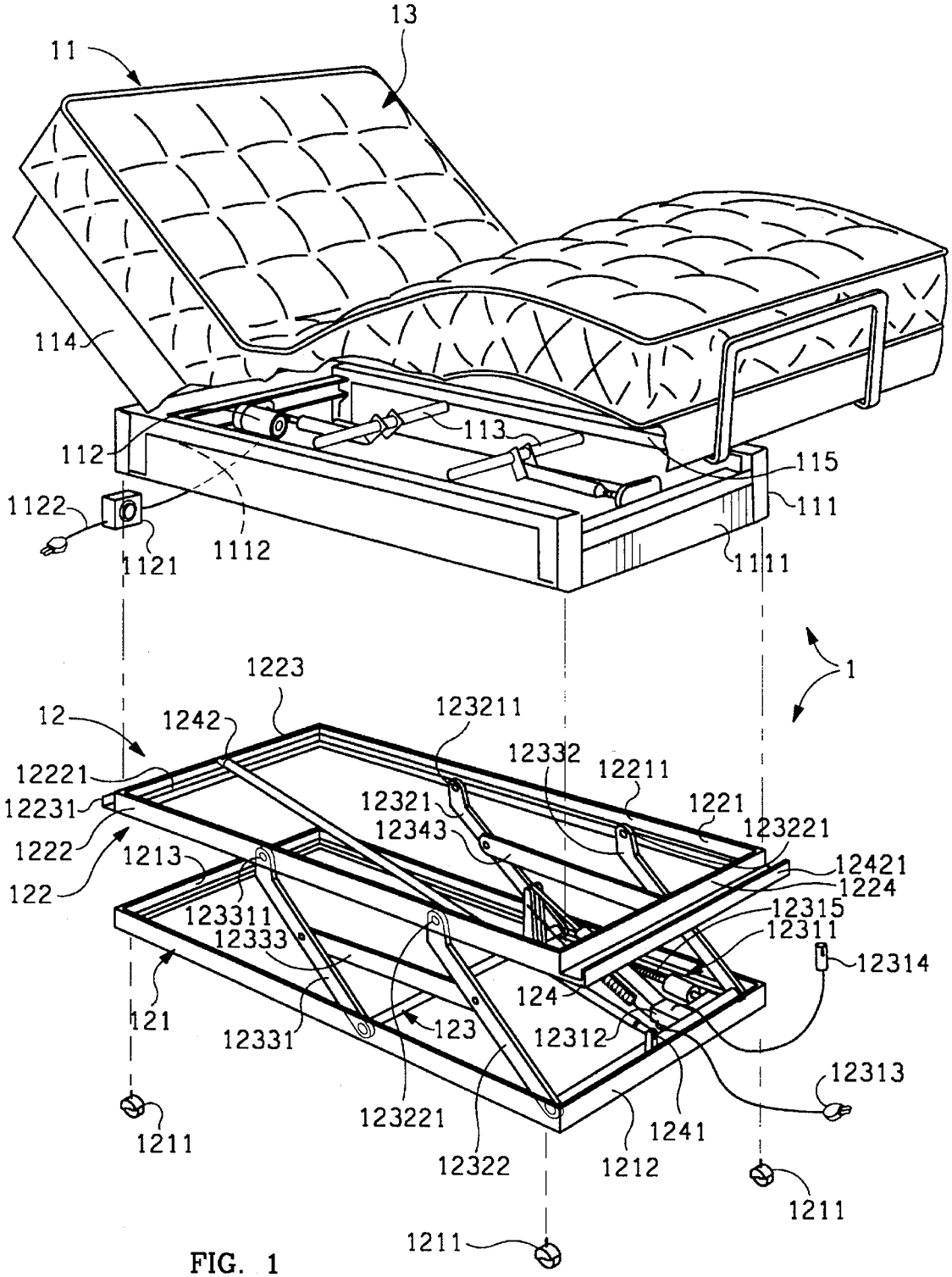
FIG. 1 is an exploded diagrammatic perspective view showing the preferred embodiment of a modular high-low-adjustable contour-adjustable bed in accordance with the present invention, the high-low-adjustable contour-adjustable bed including an uppermost contour bed and a lowermost high-low base.

An exploded diagrammatic perspective view of the preferred embodiment of a modular high-low-adjustable contour-adjustable bed 1 in accordance with the present invention is shown in FIG. 1. The high-low-adjustable contour-adjustable bed includes a contour bed 11 and a high-low base 12.

The contour base 11 is of various standard constructions. A typical contour bed includes a perimeter frame 111 within which is located one or more motors 112 electrically connected to a control panel 1121 and then, by a power cord 1122, to a source of (typically) a.c. power. The motor 112 operates to move the lever arms of rotating elements 113 so as to selectively displace the upper portion mattress support member 114 and the lower portion mattress support member 115 to various angles and elevations. These various angles impart a contour to a detachable mattress 13 that is positioned atop the support members 114,115.

In accordance with the present invention, a high-low base 12 is added by retrofit as a new assembly to an existing contour bed 11, or is furnished along with a new contour bed 11, in order to realize a complete modular high-low-adjustable contour-adjustable bed in accordance with the present invention.

The high-low base 12 includes a rectangular lower frame member 121, an rectangular upper frame member 122, and a motorized elevation assembly 123 for variably elevating the upper frame member 122 in height above the lower frame 121. An idler arm 124— rotationally connected to the lower frame member 121 by the hinge joint 1241, and to the upper frame member 122 by hinge joint 1242— serves to maintain the lower frame member 121 and the upper frame member 122 in positional alignment.

The lower frame member 121 rests upon a floor (not shown), either directly or upon typically on four castors 1211 that are disposed at the underside of the four corners of the rectangular lower frame member 121. The rectangular lower frame member 121 has and two relatively shorter, foot and head, end sides 1212, 1213.

The rectangular upper frame member 122 has and presents to its exterior at each of its two relatively shorter, foot and head, end sides 1223, 1224 a typically continuous, typically full-length, shelf 12231, 12241. The shelves 12231, 12241 form a shallow "U" channel with an upward-directed opening to the "U". The purpose of the shelves 12131 and 12141 is to engage the corresponding sides 1111, 1112 of the platform-base frame 111 to the contour bed 1.

The upper frame member 122 has and defines two (2) typically (but not necessarily) continuous, typically (but not necessarily) full-length, channels, or tracks, 12211, 12221 at the interior of its two long sides 1221 and 1222. Each channel, or track, 12211 and 12221 serves to engage, and to restrain for rolling motion, a corresponding pair of the roller assemblies 123211, 123221 and 123311, 123321 of the arms 12321, 12322 and 12331, 12332, Both the lower frame member 121 and the upper frame member 122 are commonly made from steel angle iron, typically 12 gauge alloy steel.

The motorized elevation assembly 123 is in the form of a motorized drive mechanism connecting between the lower frame member 121 and the upper frame member 122, and is located in the volume between these frame members 121, 122. The motorized elevation assembly 123 serves to variably controllably elevate the upper frame member 122 in height above the lower frame member 121.

Figure 2:
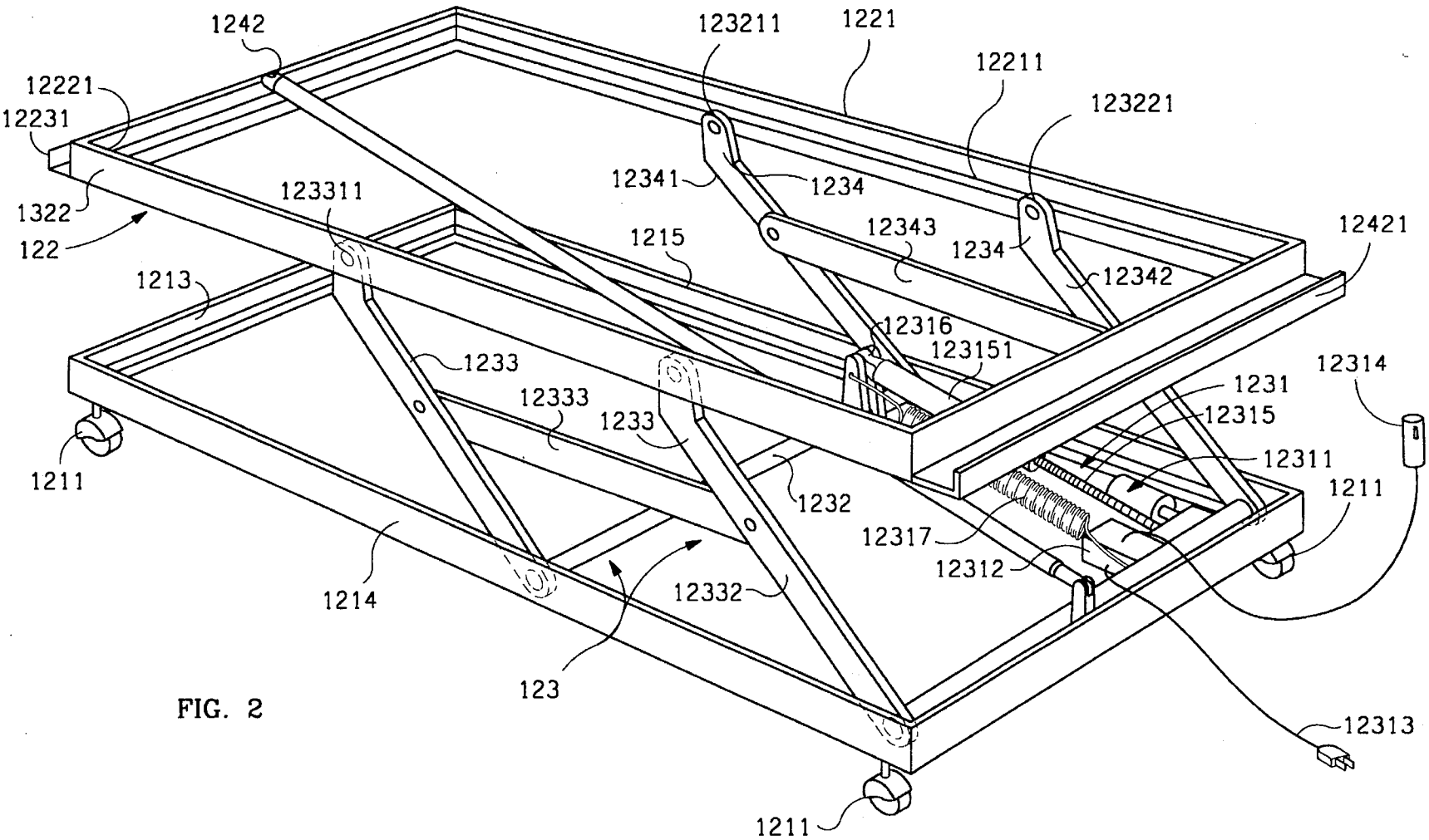
FIG. 2 is a detail view of the high-low base particularly showing the preferred motor, screw and screw and screw follower assembly that adjusts the height of the modular high-low-adjustable contour-adjustable bed in accordance with the present invention.

As is best seen in FIG. 2, the motorized elevation assembly 123 includes an electrical motor drive assembly 1231 that itself includes, as electrical components, a bi-directional electric motor 12311, an electrical junction box 12312, a power cord 12313 and a hand-held control 12314. The hand-held control 12314 serves under the momentary manual switch activation by a user (not shown) of the contour bed to gate electrical power from a wall outlet (not shown) to which power cord 12312 is connected, through the electrical junction box 12312, and to the electric motor 12311, causing the electric motor 12311 to turn the screw 12315 in a selected rotational direction.

The screw 12315 that is affixed at its one end to the motor 12311 threads at its other end a screw follower 123151. The screw follower 123151 is at one end of a lever arm 12316 that is affixed at its other end to a shaft 1232. Rotation of the screw 12315 by the motor 12311 causes the screw 12315, the screw follower 123151, and the lever arm 12316 affixed thereto to forcibly rotate the shaft 1232. Rotation of the shaft 1232 in opposite directions raises and lowers the upper frame 122, and the contour bed 11 (shown in FIG. 1) that rests thereon.

The function of the motor 12311 and its associated drive components to rotate the shaft 1232 so that the upper frame 122, and the contour bed 11 (shown in FIG. 1), become raised in elevation is aided by a strong spring 12317 that is attached between a short end 1211 of the lower frame 121 and, preferably, the same end of the lever arm 12316 to which the screw follower is attached. The spring 12317 is normally in extension, and serves to pull against the end of the lever arm 12316.

In certain versions of the high-low base 12, of the high-low-adjustable contour-adjustable bed 1 of which the base 12 is a part, the extension, and force, of the spring 12317 may be adjustably preset by a simple take-up mechanism (not shown). In this manner the force exerted by the motor 12311 both to raise, and to lower, the upper frame 122 and the contour bed 11 may be roughly balanced in anticipation of the weight of both (i) the actual contour bed 11 in use, and, optionally additionally, (ii) the rough expected weight of the occupant of the contour bed 11. The spring 12317 will thus be recognized as a common mechanism by which the strain on, and necessary forces exerted by, the motor 12311 may be reduced, and may optimally be minimized.

Meanwhile, the motorized elevation assembly 123 further includes arm pairs 1233 and 1234, each respectively consisting of two arms 12331, 12332 and 12341, 12342. The arm pairs 1233 and 1234 are opposed upon opposite long sides 1214, 1215 of the rectangularly-shaped lower frame member 121, and also upon opposite long sides 1222, 1221 of the rectangularly-shaped upper frame member 122. Each of the arms 12331, 12332 and 12341, 12342 of the respective arm pairs 1233 and 1234 is respectively rotationally affixed to the long sides 1214, 1215 of lower frame member 121, normally by a pin or bearing (not shown), or by such other means as are common for the creation of hinge joints. Each of the arms 12331, 12332 and 12341, 12342 of the respective arm pairs 1233 and 1234 is respectively affixed for rotating and sliding relative to the channels 12211, 12221 of the long sides 1221, 1222 of upper frame member 122, normally by sliding wheel bearing (not shown), or by such other means as are common for the creation of low-friction sliding joints.

An optional linkage 12333 connects the arms 12331, 12332 of the arm pair 1233, and an optional linkage 12343 connects the arms 12341, 12342 of the arm pair 1234 in order to impart extra stability and strength. The shaft 1232 is immovably affixed to the ends of one arm of each of the opposed arm pairs 1233, 1234, namely to arms 12331 and 12341, at the points of the rotatable affixation of these arms 12331,12341 to the long sides 1214, 1215 of the lower frame member 121.

By these fixed, rotating and sliding connections, rotation of the screw 12315 by the motor 12311 causes the screw follower 123151 and the lever arm 12316 affixed thereto to forcibly rotate the shaft 1232, turning the arms 12331, 12341 connected to the shaft 1232 and changing the angle thereof relative to each of the lower frame member 121 and the upper frame member 122. As this angle changes the lower frame member 121 and the upper frame member 122 are forced to a variable degree of separation one from the other.

The motorized elevation assembly 123 includes as it largest non-peripherally-located components the motor 12311, the shaft 1232, and the idler arm 124. These components may suitably occupy complementary voids in the parallelepiped volume enclosed by the frame 111 of the contour bed 11. The frame 111 is substantially in the shape of the four-sided, topless and bottomless, rectangular box. As is illustrated, a portion of the volume enclosed by this frame 111 is void, or empty. The motor 12311 and the remaining associated elements of the motorized elevation assembly fit within this void when the high-low base 12 is fully retracted.

In accordance with the preceding explanation, variations and adaptations of the modular high-low-adjustable contour-adjustable bed in accordance with the present invention will suggest themselves to a practitioner of the mechanical design arts. The sides of the high-low base upon which the arm pairs 1233, 1234 are disposed could have been the short, as opposed to the long, sides. The high-low base could even be of other than rectangular geometry, and may in particular be round. Height adjustment of the high-low base could have been by hydraulic or pneumatic, as opposed to electrical and mechanical, means. The high-low base could be bolted, or otherwise affixed, at the underside of the contour bed— in which case the shelves 12231 and 12421 are unnecessary and the castors 1211 could alternatively be affixed to the base of the contour bed frame 111 as opposed to the high-low base 12. (In this case, the castors 1211 would lift along with the frame 111 of the contour bed 11.)

In accordance with these and other possible variations and adaptations of the present invention, the scope of the invention should be determined in accordance with the following claims, only, and not solely in accordance with that embodiment within which the invention has been taught.

What is claimed is:

1. A bed that is adjustable in both height above a floor upon which the bed is supported and also in the contours of a mattress that is supported upon the bed, the adjustable-height and adjustable-contour bed comprising:

a high-low base having a lower frame member supported upon a floor, an upper frame member, and elevation means for variably elevating the upper frame member in height above the lower frame member and above the floor upon which the lower frame member is supported, wherein the lower frame member at least partially circumscribes an area, the upper frame member at least partially circumscribes an area, and when the upper frame member is elevated in height above the lower frame member by action of the elevation means then the two frame members define between them a volume, and wherein the elevation means occupies less than the totality of the volume defined by the elevated upper frame member and the floor-supported lower frame member, a portion of the volume void and empty; and a contour bed means, stably resting upon the upper frame member of the high-low base and having an adjustable upper surface, for supporting, and for variably adjusting the contours of, a mattress that rests upon the upper surface, the contour bed means having a peripheral frame, a substantially planar bendable support member for supporting a mattress upon its upper surface, and motorized means, located within the peripheral frame and affixed between this frame and the bendable support member, for variably bending the support member in order that a variable contour may be imparted to the mattress upon the support member's upper surface, wherein the motorized means occupies less than the totality of the volume enclosed by the peripheral frame, a portion of the volume enclosed by the peripheral frame being void and empty;

wherein the contour bed need not mechanically affix the high-low base, it being sufficient only that it should rest stably thereon in order that any adjustment in height of the upper frame of the high-low base should serve to commensurately adjust the height of the contour bed means and of the mattress that is supported upon the contour bed means;

wherein the volume defined by the peripheral frame of the contour bed when the upper frame member of the high-low base is in its full down position is substantially the same volume defined by the elevated upper frame member and the floor-supported lower frame member of the high-low base when the upper frame member is in its elevated position;

wherein the elevation means of the high-low base fits substantially completely within the void of the volume enclosed by the peripheral contour bed frame upon such times as the elevation means places the upper frame member in its full down position;

wherein the motorized means of the contour bed also fits substantially completely within the void of the volume defined by the elevated upper frame member and the floor-supported lower frame member upon such times as the elevation means places the upper frame member in its full down position; and wherein the elevation means of the high-low bed, and the motorized means of the contour bed, fit together in substantially the same volume.

2. The adjustable-height and adjustable-contour bed according to claim 1 wherein the upper frame member of the high-low base is adjustable in height independently of the variable adjustment of the contours of the mattress by the contour bed means.

3. The adjustable-height and adjustable-contour bed according to claim 1 wherein the contour bed means further comprises:

a surround skirt of horizontal dimensions sufficient so as to fit circumferentially about the high-low base, and of a vertical dimension sufficient so as to essentially bridge a vertical gap between the mattress and the floor when the high-low base is in its full down position;

wherein the surround skirt of the contour bed, which is part of the contour bed and thus variable in height above the floor in accordance that the high-low base varies the height of the contour bed, serves to surround the high-low base, and to enclose it from view, when the high-low base is in its full down position.

4. A high-low-adjustable contour-adjustable bed comprising;

a contour bed frame substantially in the shape of the side walls of a rectangular box having an open bottom and an open top, a substantially planar bendable support member for supporting a mattress upon its upper surface, and motorized means, located within the contour bed frame and affixed between this frame and the bendable support member, for variably bending the support member in order that a variable contour may be imparted to the mattress upon the support member's upper surface, wherein the motorized means occupies less than the totality of the volume enclosed by the contour bed frame substantially in the shape of the topless and bottomless rectangular box, a portion of the volume enclosed by the contour bed frame being void and empty, and a high-low base comprising:

a lower frame member supported upon a floor;

an upper frame member; and elevation means for variably elevating the upper frame member in height above the lower frame member and above the floor upon which the lower frame member is supported;

wherein the upper frame member is of suitable complimentary size and shape so as to engage the contour bed frame so that this frame, and the entire contour bed, is variably elevated in height above the floor in accordance that the upper frame member is so elevated; and wherein, nonetheless that the upper frame member engages the contour bed frame, the entirety of the (i) lower frame member, (ii) upper frame member, and (iii) elevation means fits substantially completely within the void of the volume enclosed by the contour bed frame upon such times as the elevation means places the upper frame member in its full down position.

5. The high-low-adjustable contour-adjustable bed according to claim 4 wherein the elevation means comprises:

a motorized drive mechanism connecting between the lower frame member and the upper frame member in the volume between them for variably elevating the upper frame member in height above the lower frame member; and an idler arm for maintaining the lower frame member and the upper frame member in positional alignment.

6. The high-low-adjustable contour-adjustable bed according to claim 4 frictional points of contact between the high-low base positioned under the contour bed so as to lift the contour bed in height, and the contour bed positioned above the high-low base so as to be lifted in height, so that the contour base rests stably above the high-low base solely by frictional contact and without fasteners or connectors;

wherein the high-low base may be added by retrofit without tools to the contour bed in its position thereunder because it is not connected thereto by fasteners nor connectors, with the contour bed simply resting atop the high-low base under force of gravity.

7. A high-low-adjustable contour-adjustable bed comprising:

a contour bed frame substantially in the shape of the side walls of a rectangular box having an open bottom and an open top, a substantially planar bendable support member for supporting a mattress upon its upper surface, and motorized means, located within the contour bed frame and affixed between this frame and the bendable support member, for variably bending the support member in order that a variable contour may be imparted to the mattress upon the support member's upper surface, wherein the motorized means occupies less than the totality of the volume enclosed by the contour bed frame substantially in the shape of the topless and bottomless rectangular box, a portion of the volume enclosed by the contour bed frame being void and empty, the high-low base comprising:

a lower frame member supported upon a floor;

an upper frame member having and defining a plurality of tracks; and an elevation means for variably elevating the upper frame member in height above the lower frame member and above the floor upon which the lower frame member is supported, the elevation means comprising a motorized drive mechanism connecting between the lower frame member and the upper frame member in the volume between them for variably elevating the upper frame member in height above the lower frame member, the motorized drive mechanism comprising a plurality of arms each rotationally affixed to the lower frame member at a one end thereof and engaging the upper frame member at the other end thereof by sliding in a one of the plurality of tracks of the upper frame member, and a motor means for driving the plurality of arms to various angles relative to each of the lower frame member and the upper frame member, therein to force the lower frame member and the upper frame member to a variable degree of separation one from the other; and an idler arm for maintaining the lower frame member and the upper frame member in positional alignment;

wherein the upper frame member is of suitable complimentary size and shape so as to engage the contour bed frame so that this frame, and the entire contour bed, is variably elevated in height above the floor in accordance that the upper frame member is so elevated; and wherein, nonetheless that the upper frame member engages the contour bed frame, the entirety of the (i) lower frame member, (ii) upper frame member, and (iii) elevation means fits substantially completely within the void of the volume enclosed by the contour bed frame upon such times as the elevation means places the upper frame member in its full down position.

8. The high-low-adjustable contour-adjustable bed according to claim 7 wherein pairs of the plurality of arms are opposed at opposite side walls of the contour bed frame substantially in the shape of a rectangular box; and wherein the motor means further comprises:

a shaft connecting one pair of opposed arms at the points of their rotatable affixation to the lower frame member;

a lever arm connected at one of its ends to the shaft;

a screw follower affixed to the other end of the lever arm;

a screw threading the screw follower; and an electric motor for rotating the screw so that the screw follower and the one end of the lever arm affixed thereto may be forced to rotate the shaft in order to turn the pair of arms connected to the shaft so as to change the angle thereof relative to each of the lower frame member and the upper frame member, therein to force the lower frame member and the upper frame member to the variable degree of separation one from the other.

9. A high-low base for use with, under and supporting a pre-existing contour bed, the high-low base being vertically extendible in a range from a retracted first position supporting the contour bed at a predetermined low height suitable for a level transfer of a patient from a wheelchair to a bed, to an intermediary second position supporting the contour bed at an intermediary height, greater than the low height, suitable for a gravity-assisted transfer of a patient from the bed to a wheelchair, to an extended third position supporting the contour bed at a high height, greater than the intermediary height, suitable for care-giving to a patient lying supine upon the bed, the high-low base comprising:

a lower frame member, supported upon a floor, of complimentary size and rectangular shape so as to fit within a rectangular pedestal base of a pre-existing contour bed;

an upper frame member also of complimentary size and rectangular shape so as to fit within the rectangular pedestal base of the pre-existing contour bed, therein to come into contact with such frame elements of the adjustable bed as are within its pedestal base in a manner that permits forcible level lifting of these frame elements and of the pedestal base and of the entire contour bed of which the pedestal base and its frame elements are a part, the upper frame member having and defining a plurality of tracks;

elevation means, connecting between the lower frame member and the upper frame member and located in the volume between them, for variably elevating the upper frame member in height above the lower frame member and above the floor upon which the lower frame member is supported, the elevation means comprising a motorized drive mechanism, connecting between the lower frame member and the upper frame member and located in the volume between them, for variably elevating the upper frame member in height above the lower frame member, the motorized drive mechanism comprising a plurality of arms each rotationally affixed to the lower frame member at a one end thereof and sliding in a one of the plurality of tracks of the upper frame member at the other end thereof, and a motor means for driving the plurality of arms to various angles relative to each of the lower frame member and the upper frame member, therein to force the lower frame member and the upper frame member to a variable degree of separation one from the other; and an idler arm for maintaining the lower frame member and the upper frame member in positional alignment.

wherein the lower frame member, the upper frame member and the elevation means are collectively so low and squat in the retracted first position of the elevation means that they all together fit within the rectangular pedestal base of the preexisting contour bed, while the contour bed is at the low height suitable for a level transfer of a patient from a wheelchair to a bed;

wherein the upper frame member is vertically extendible in the second position of the elevation means so as to lift the contour bed to the intermediary height suitable for a gravity-assisted transfer of a patient from the bed to a wheelchair;

wherein the upper frame member is further vertically extendible in the third position of the elevation means so as to lift the contour bed to the high height suitable for care-giving to a patient lying supine upon the bed;

wherein the high-low base suffices to lift the contour bed over a range of heights.

10. The high-low base according to claim 9 wherein pairs of the plurality of arms are opposed upon opposite sides of both the rectangularly-shaped lower and upper frame members;

and wherein the motor means further comprises:

a shaft connecting one pair of opposed arms at the points of their rotatable affixation to the lower frame member;

a lever arm connected at one of its ends to the shaft;

a screw follower affixed to the other end of the lever arm;

a screw threading the screw follower; and an electric motor for rotating the screw so that the screw follower and the one end of the lever arm affixed thereto may be forced to rotate the shaft to turn the pair of arms connected to the shaft to change the angle thereof relative to each of the lower frame member and the upper frame member, therein to force the lower frame member and the upper frame member to the variable degree of separation one from the other.

11. The high-low base according to claim 9 frictional points of contact between the high-low base positioned under the contour bed so as to lift the contour bed in height, and the contour bed positioned above the high-low base so as to be lifted in height, so that the contour base rests stably above the high-low base solely by frictional contact and without fasteners or connectors;

wherein the high-low base may be added by retrofit without tools to the contour bed in its position thereunder because it is not connected thereto by fasteners nor connectors, with the contour bed simply resting atop the high-low base under force of gravity.

* * * * *